US006764052B1

(12) United States Patent
Wise

(10) Patent No.: US 6,764,052 B1
(45) Date of Patent: Jul. 20, 2004

(54) HOLDER FOR HAIR DRYER OR OTHER HAND HELD APPLIANCE

(76) Inventor: Linda A. Wise, P.O. Box 86603, San Diego, CA (US) 92138

( * ) Notice: Subject to any disclaimer, the term of this patent is extended or adjusted under 35 U.S.C. 154(b) by 0 days.

(21) Appl. No.: 10/345,447

(22) Filed: Jan. 14, 2003

(51) Int. Cl.[7] ..... F16B 45/00
(52) U.S. Cl. ..... 248/304
(58) Field of Search ..... 248/304, 305, 248/307, 339, 211, 215, 242, 244, 241; 211/106.01, 60.1

(56) References Cited

U.S. PATENT DOCUMENTS

| | | | | | |
|---|---|---|---|---|---|
| 2,535,564 | A | * | 12/1950 | Campbell | 224/42.42 |
| 4,108,313 | A | * | 8/1978 | Bogar, Jr. | 211/64 |
| 4,201,304 | A | * | 5/1980 | Wicklund | 211/88.04 |
| D262,337 | S | | 12/1981 | Bateman et al. | |
| 4,372,450 | A | * | 2/1983 | Licari et al. | 211/106.01 |
| D305,431 | S | | 1/1990 | Adams | |
| 4,949,924 | A | * | 8/1990 | Carmody | 248/215 |
| 5,074,419 | A | * | 12/1991 | Smith | 211/17 |
| 5,203,462 | A | * | 4/1993 | Brooks | 211/14 |
| D335,935 | S | | 5/1993 | Rouail | |
| D347,538 | S | | 6/1994 | Fleischer | |
| 5,577,697 | A | * | 11/1996 | Accordino | 248/206.5 |
| 5,590,475 | A | | 1/1997 | Andis | |
| 5,595,333 | A | * | 1/1997 | Boston | 244/536 |
| 5,630,517 | A | * | 5/1997 | Maznik | 211/70.6 |
| 5,810,304 | A | * | 9/1998 | Lehrman | 248/215 |
| D414,364 | S | | 9/1999 | Malcolm, Sr. | |
| 6,003,691 | A | * | 12/1999 | Owen | 211/65 |
| 6,109,460 | A | * | 8/2000 | Herlevi et al. | 211/85.13 |
| 6,152,313 | A | * | 11/2000 | Klein et al. | 211/113 |
| 6,273,279 | B1 | * | 8/2001 | Wolf | 211/86.01 |
| 6,302,365 | B1 | * | 10/2001 | Catanzarite et al. | 248/339 |
| 6,450,378 | B1 | * | 9/2002 | Miller | 224/275 |
| 6,598,915 | B2 | * | 7/2003 | Ngo et al. | 294/27.1 |
| 6,669,067 | B2 | * | 12/2003 | Schuster | 224/543 |
| 2002/0144962 | A1 | * | 10/2002 | Dettorre et al. | 211/85.7 |

* cited by examiner

*Primary Examiner*—Leslie A. Braun
*Assistant Examiner*—A. Joseph Wujciak
(74) *Attorney, Agent, or Firm*—Gordon & Rees LLP

(57) ABSTRACT

A holder for a hand held appliance has first and second hook members for supporting the handle and head of the appliance, respectively, and at least one cross bar for connecting the two hook members together such that the hook members project outwardly from a flat surface to which the holder is secured. The hook members and cross bar are formed separately and are releasably secured to one another prior to attachment to a flat surface.

16 Claims, 2 Drawing Sheets

HOLDER FOR HAIR DRYER OR OTHER HAND HELD APPLIANCE

BACKGROUND OF THE INVENTION

The present invention relates generally to a holder or support for attachment to a wall, the holder being designed to hold a hand held electrical appliance such as a hair dryer or the like.

It is convenient to store hand held electrical appliances such as hair dryers, curling irons, shavers, and the like in places where they are readily accessible for use. In hotels, hair dryers are placed in wall mounted, shelf-like stands in bathrooms. One such stand is described in U.S. Pat. No. 5,590,475 of Andis, which describes a cradle like device having a first, arcuate seat for receiving the head of the hair dryer, a recess for receiving the handle of the hair dryer at the location of the on-off switch, and a lower end on which the lower end of the dryer is seated. The recess is designed to automatically move the switch into an off position when-the hair dryer is seated in the device.

Other holders or stands for hair dryers are described in U.S. Design Pat. No. 347,538 of Fleischer, U.S. Design Pat. No. 414,364 of Malcolm, Sr., and U.S. Design Pat. No. 335,935 of Rouail. All of these holders are generally formed in one piece which is mounted on a vertical wall surface, and are relatively bulky.

SUMMARY OF THE INVENTION

It is an object of the present invention to provide a new and improved holder for an electrical appliance such as a hair dryer.

According to the present invention, a holder for a hand held appliance having a handle portion and a head portion with an electrical lead connected to the handle portion is provided, which comprises a first hook member, a second hook member, and at least one cross bar for connecting the two hook members together such that the hook members project outwardly from a flat surface to which the holder is secured, the hook members and cross bar being formed separately and being releasably securable to one another prior to attachment to a flat surface.

In one embodiment of the invention, each hook member has a first, generally straight portion extending from one end, and a curved, hook portion at the other end, and the cross member is secured between the straight portions of the hook members. The cross member has at least one angled bend such that the straight portion of the second hook member is secured at an angle to the straight portion of the first hook member. There may be two spaced cross members secured between the hook members for added strength, each cross member having an equivalent angled bend in its length. The cross members may also have openings for receiving suitable fasteners for securing the assembled holder to a flat surface such as a wall or cabinet.

In an exemplary embodiment, the opposite ends of the cross members have first snap engaging formations and the straight portions of the hook members have corresponding, second snap engaging formations for releasable snap engagement with the first formations on the cross members. In one example, the first snap engaging formations comprise pins of reduced dimensions projecting from the ends of the cross members, while the second snap engaging formations comprise corresponding openings in the straight portions of the hook members. The openings may extend all the way through the hook members, such that they may be secured to the cross members in a first orientation in which each hook portion extends in a first direction transverse to the cross bars, or in a second orientation in which each hook portion is rotated through 180° from the first orientation to extend in a second direction opposite to the first direction. Since the first hook member is intended to support the head portion of an appliance such as a hair dryer, and the second hook member is intended to support the handle portion, the ability to assemble the holder with the hook portions extending in opposite directions allows the holder to be modified for right or left handed users.

The holder in the exemplary embodiment is assembled from three or four parts which are designed to snap together. This allows the assembly to be stored and shipped with the parts separated and stored in a generally flat, compact package. The parts may be of molded plastic material, such that they are lightweight, inexpensive to manufacture, and can be made in various colors to match bathroom color schemes.

The hair dryer holder of this invention is easy to assemble and may be mounted on any convenient surface such as a wall, cupboard surface, or the like. The holder will keep the hair dryer secure against the wall where it is conveniently ready for use. The hair dryer is held flat against the wall and does not project outwardly any significant distance or cause any obstruction. It can be installed near the outlet used by the dryer, so that the dryer does not need to be unplugged after use.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
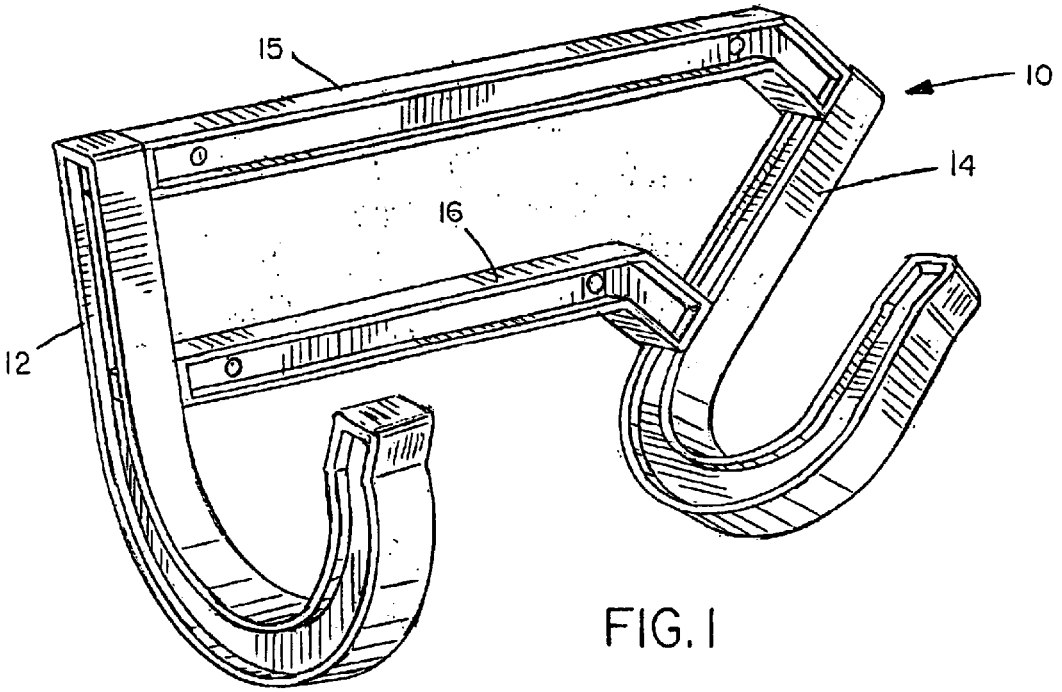
FIG. 1 is a perspective view of the assembled holder according to an exemplary embodiment of the invention.
Figure 2:
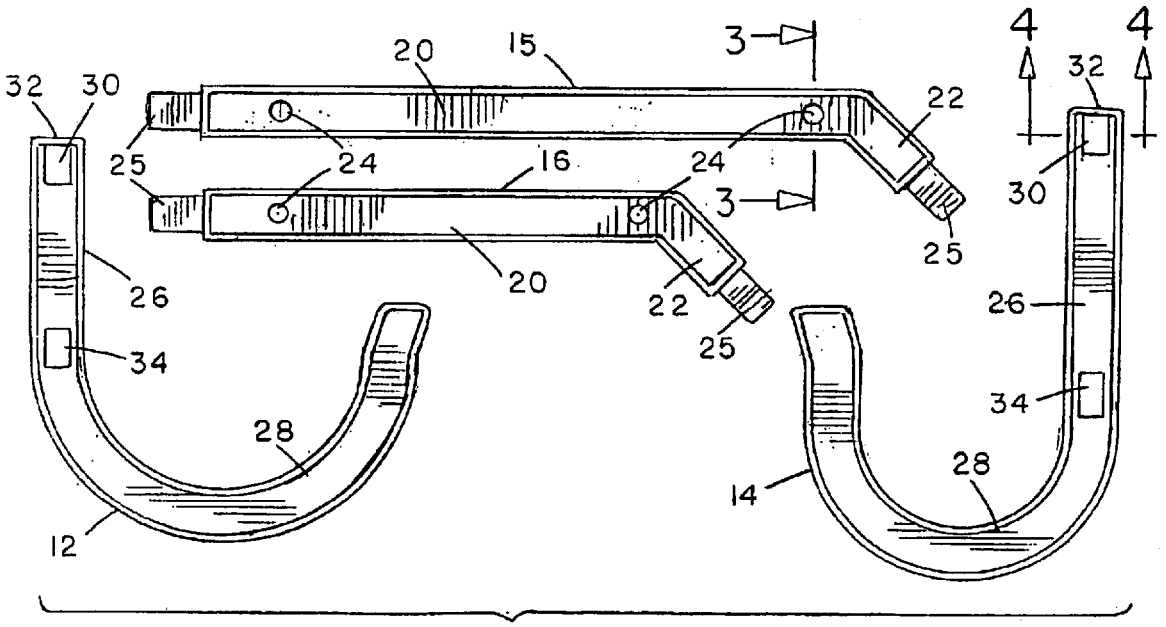
FIG. 2 is a plan view of the separated components of the holder.

FIGS. 1 to 6 illustrate a hair dryer holder 10 according to an exemplary embodiment of the invention. FIG. 1 illustrates the holder in an assembled configuration ready for mounting on a surface such as a vertical wall, cupboard door, or the like, while FIG. 2 illustrates the four parts of the holder separated prior to assembly. The holder 10 basically comprises first and second hook members 12 and 14 and a pair of cross bars 15, 16 extending between the hook members. Additionally, screw fasteners 18 or the like (see FIGS. 5 and 6) are provided for mounting the holder on a suitable flat surface. The first hook member 12 is larger than the second hook member 14, as best illustrated in FIG. 2, while the first cross bar 15 is longer than the second cross bar.

Figure 3:
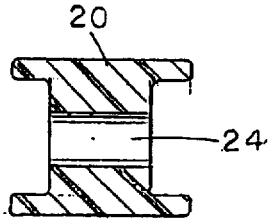
FIG. 3 is an enlarged sectional view taken on line 3—3 of FIG. 2.

The four basic parts of the hair dryer holder are suitably formed from relatively strong and durable plastic material, such as polypropylene, which may be extruded or molded to form the parts. Each cross bar 15, 16 has a straight portion 20 extending over the majority of its length and an angled end portion 22 extending at an obtuse angle of around 110° to 150° to the straight portion. A pair of spaced openings 24 are provided in th straight portion 20 of each cross bar, for receiving the mounting devices or screw fasteners 18, as described in more detail below. Each cross bar is of H-shaped cross-section, as indicated in FIG. 3, for added strength. A connector pin 25 of reduced dimensions projects from each end of each of the cross bars. The holder parts may be made in various colors to match different bathroom decors.

Figure 4:
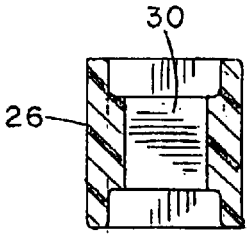
FIG. 4 is an enlarged sectional view taken on line 4—4 of FIG. 2.

Each hook member 12, 14 is of similar channel or H-shaped cross section to the cross bars, as illustrated in FIG. 4, and has a straight first portion 26 and a U-shaped or arcuate hook portion 28 co-planar with the straight portion. A first, generally rectangular through hole 30 is provided adjacent the first end 32 of each hook member, and a second, identical through hole 34 is provided in the straight portion at a location spaced from the first hole 30. Each hole is of predetermined dimensions substantially matching the cross-sectional dimensions of the connector pins 25 for close sliding, frictional or snap-like engagement with the pins.

When the four basic parts of the holder are separate as in FIG. 2, they may be packaged in a flat condition for storage or shipping purposes, together with the necessary hardware, such as fastener screws and wall anchors. In order to assemble the holder, the angled end portions 22 of the cross bars are placed adjacent the straight portion of the smaller hook 14. The pin 25 projecting from the angled end portion 22 of the longer cross bar 15 is then inserted into the hole 30 at the end of the straight portion of hook 14, while the pin 25 projecting from the angled end portion of the shorter cross bar 16 is inserted into the second hole 32 in hook 14. The pins are a close sliding or friction fit into the respective holes, such that they must be forced in and will be held in place unless forced apart. The pins 25 projecting from the opposite ends of the cross bars are then urged into the corresponding holes 30,32 in the larger hook 12, so that the hooked or U-shaped end portions of the hooks project outwardly from the plane defined by the cross bars and straight portions of the hooks, in the manner indicated in FIG. 1.

Figure 5:
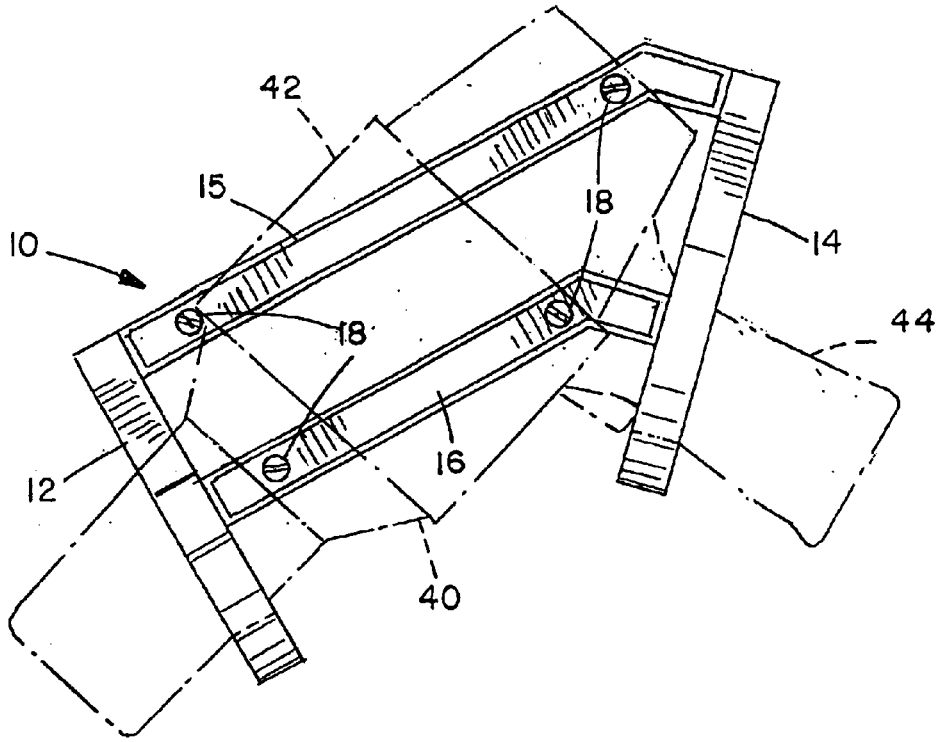
FIG. 5 is a front view of the holder with a hair dryer or the like in place.

The assembled holder is now ready to be mounted on a wall or other flat surface. It is first placed against the wall in the desired position and at the desired orientation. Since the larger hook 12 is intended to support the head 40 of a hair dryer 42, as indicated in FIG. 5, while the smaller hook is intended to support the handle 44, the holder should be positioned with the straight portions 20 of the cross bars angled downwardly, to best distribute the weight of the hair dryer, and at a location close enough to a wall socket to enable the dryer to be plugged into the socket when supported in the holder. When the holder is appropriately positioned, the wall or surface is marked through the openings 24 in the cross bars, and the holder is put aside. A hole is then drilled into the wall or surface at each mark, and a wall anchor is tapped into each hole. The holder is then repositioned with the openings 24 located in alignment with the wall anchors, and a screw 18 is inserted through each opening and into the aligned wall anchor. The hair dryer can then be placed in the holder and will be conveniently located ready for use at all times.

Figure 6:
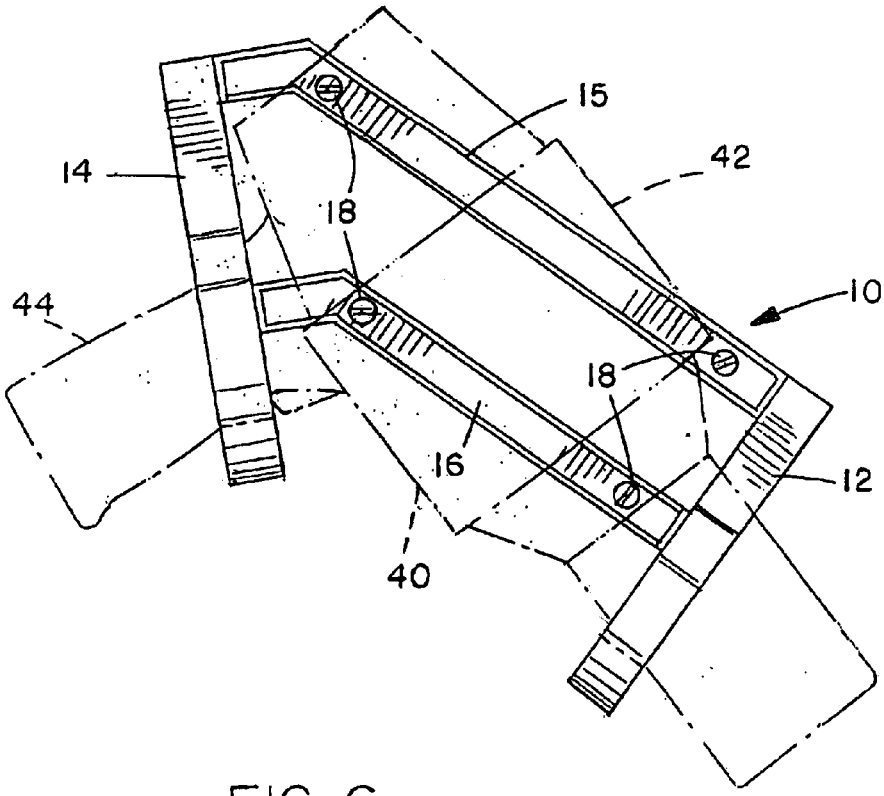
FIG. 6 is a similar view but with the holder assembled for left hand use.

FIGS. 1 and 5 illustrate the hair dryer positioned for use by a right handed user. However, the holder can alternatively be assembled for left handed use, as indicated in FIG. 6, such that the handle 44 is to the left of the head when supported on the holder, rather than to the right as in FIG. 5. In order to assemble the holder for right handed users, the cross-bars are first positioned on a flat surface as indicated in FIG. 2, with the angled end portions 22 on the right, such that the smaller hook 14 which supports the handle is secured to the right of the larger hook which supports the head 40 of the hair dryer. In order to assemble the holder for left handed users, each cross bar is reversed from the position indicated in FIG. 2 so that the angled end portions 22 are to the left of the straight portions 20, and the smaller hooks 14 are then secured to the left hand ends of the cross bars with the larger hooks 12 secured to the right. Alternatively, if the hooks 12 and 14 have been secured to the cross bars in a right hand orientation as in FIG. 1, they may simply be popped off the ends of the cross bars, rotated or turned around to face in the opposite direction, and then popped back onto the connector pins 25 at the ends of the cross bars. FIG. 6 illustrates the holder 10 assembled in a left hand orientation and secured to a suitable surface for supporting a hair dryer 42 at an appropriate position for a left handed user.

Although the holder 10 in the illustrated embodiment has a pair of cross bars extending between the hook members, only a single cross bar may be used in alternative embodiments. Additionally, instead of pins on the cross bars engaging in holes in the hook members to secure the parts together, holes may be provided in the ends of the cross bars to engage pins projecting from the hook members. Other types of releasable fasteners may alternatively be used, .including snap engaging formations. The holder may also be formed in one piece if desired, although the multi-part construction is more compact and convenient for shipping purposes.

The overall holder design with two hooks secured at an angle to one another via cross bars allows for compact and convenient storage of a hair dryer or the like when not in use. The holder of this invention may be designed for holding other hand held electrical appliances, such as curling irons, shavers, and the like, although it is particularly intended for hair dryers which are typically used on a daily basis. It is inexpensive and easy to assemble and install. It can readily be positioned adjacent an appropriate wall socket so that a hair dryer can be stored while plugged in and ready for use. The holder may be assembled for a right handed or left handed user with the handle supporting hook either on the right or the left, respectively, adding to its convenience. The holder is designed to hold the hair dryer flat against the wall or other surface on which it is mounted, so that the dryer does not project outwardly or take up unnecessary space. The multi-part construction allows the holder parts to be stored and shipped in a relatively small, flat package, while the parts are quickly and easily assembled on site.

Although an exemplary embodiment of the invention has been described above by way of example only, it will be understood by those skilled in the field that modifications may be made to the disclosed embodiment without departing from the scope of the invention, which is defined by the appended claims.

I claim:

1. A holder assembly for a hand held appliance, comprising:

a first hook member for supporting the handle of an appliance;

a second hook member for supporting the head of an appliance;

each hook member having a first, leg portion and a second, hooked end portion;

at least one cross bar extending between the hook members having a first end secured to the leg portion of the first hook member and a second end secured to the leg portion of the second hook member;

the hook members and cross bar being formed as separate parts and the leg portion of each hook member having a first fastener and each end of the cross bar having a second fastener for releasable engagement with a respective first fastener to secure the cross bar to the respective hook member;

the cross bar and first, leg portions of the hook members being co-planar and being adapted for securing flat against a support surface with the hook members projecting outwardly from the surface; and the cross bar having a first straight portion extending from said first end and a second straight portion at an angle to the first portion extending from said first portion up to said second end, whereby the leg portion and the hooked end portion of the first hook member is at an angle relative to the leg portion and hooked end portion of the second hook member.

2. The assembly as claimed in claim 1, wherein two cross bars extend between the hook members, each cross bar having a first end secured to the leg portion of the first hook member and a second end secured to the leg portion of the second hook member.

3. A holder assembly for a hand held appliance, comprising:

a first hook member for supporting the handle of an appliance;

a second hook member for supporting the head of an appliance;

each hook member having a first, leg portion and a second, hooked end portion;

two cross bars extending between the hook members, each cross bar having a first end secured to the leg portion of the first hook member and a second end secured to the leg portion of the second hook member;

the hook members and cross bars being formed as separate parts and the leg portion of each hook member having a first fastener and each end of the cross bars having a second fastener for releasable engagement with a respective first fastener to secure the cross bar to the respective hook member;

the cross bars and first, leg portions of the hook members being co-planar and being adapted for securing flat against a support surface with the hook members projecting outwardly from the surface; and the cross bars are of different lengths.

4. The assembly as claimed in claim 3, wherein the first hook member is of smaller dimensions than the second hook member.

5. The assembly as claimed in claim 1, wherein the cross bar has openings for receiving fasteners to secure the cross bar against a support surface such that the hook members project outwardly from the surface.

6. The assembly as claimed in claim 1, wherein the hook members are reversible relative to the cross bar between a first configuration in which the hook members project in a first direction transverse to the cross bar and a second configuration in which the hook members project in a second direction opposite to the first direction and transverse to the cross bar, the first fasteners being releasably engageable with the second fasteners in each of said configurations.

7. A holder assembly for a hand held appliance, comprising:

a first hook member for supporting the handle of an appliance;

a second hook member for supporting the head of an appliance;

each hook member having a first, leg portion and a second, hooked end portion;

at least one cross bar extending between the hook members having a first end secured to the leg portion of the first hook member and a second end secured to the leg portion of the second hook member;

the hook members and cross bar being formed as separate parts and the leg portion of each hook member having a first fastener and each end of the cross bar having a second fastener for releasable engagement with a respective first fastener to secure the cross bar to the respective hook member;

the cross bar and first, leg portions of the hook members being co-planar and being adapted for securing flat against a support surface with the hook members projecting outwardly from the surface;

the hook members being reversible relative to the cross bar between a first configuration in which the hook members project in a first direction transverse to the cross bar and a second configuration in which the hook members project in a second direction opposite to the first direction and transverse to the cross bar, the first fasteners being releasably engageable with the second fasteners in each of said configurations; and each first fastener comprises a through hole in the leg portion of the respective hook member, and each second fastener comprises a pin projecting from the respective end of the cross bar, the pins and holes being of predetermined cross-sectional shape and dimensions such that each pin is a dose sliding fit in the respective hole.

8. The assembly as claimed in claim 7, wherein a second cross bar extends between the hook members parallel to and spaced from the first cross bar, the leg portion of each hook member having a second through hole spaced from the first mentioned through hole, and the second cross bar having a pin projecting from each end for releasable engagement in the respective second through hole.

9. The assembly as claimed in claim 8, wherein each cross bar has a first straight portion and a second straight portion extending at an angle to the first straight portion.

10. The assembly as claimed in claim 9, wherein the angle is in the range from 110° to 150°.

11. A holder for a hand held appliance, comprising:

a first hook member;

a second hook member;

at least one cross bar extending between the hook members and having opposite ends secured to the respective hook members;

the cross bar being adapted for securing flat against a flat, planar support surface with the hook members projecting outwardly from the support surface to support an appliance against the surface; and the first hook member being oriented at an angle to the second hook member whereby the first hook member can support a handle of an appliance while the head of the appliance rests on the second hook member.

12. The holder as claimed in claim 11, wherein the hook members and cross bars are formed separately.

13. The holder as claimed in claim 12, wherein each hook member has a first releasable fastener formation and the cross bar has opposite ends each having a second fastener formation for releasable connection with a respective first fastener formation to secure the cross bar between the hook members.

14. A holder for a hand held appliance, comprising:

a first hook member;

a second hook member;

a first cross bar extending between the hook members and having opposite ends secured to the respective hook members;

a second cross bar extending between the hook members at a spacing from the first cross bar;

the cross bars being adapted for securing flat against a support surface with the hook members projecting outwardly from the support surface to support an appliance against the surface; and the first hook member being oriented at an angle to the second hook member whereby the first hook member can support a handle of an appliance while the head of the appliance rests on the hook member.

15. The holder as claimed in claim 14, wherein each cross bar has a first portion and a second portion extending at an angle to the first portion, whereby the hook members are supported at an angle to each other.

16. The holder as claimed in claim 14, wherein each cross bar has at least two openings for receiving fasteners for securing the holder to a wall surface.

* * * * *